US009149672B2

(12) United States Patent
Al-Anzi

(10) Patent No.: US 9,149,672 B2
(45) Date of Patent: Oct. 6, 2015

(54) ENCAPSULATED FIRE EXTINGUISHING AGENTS

(76) Inventor: Bader Shafaqa Al-Anzi, Abdulla Almubarak (KW)

( * ) Notice: Subject to any disclaimer, the term of this patent is extended or adjusted under 35 U.S.C. 154(b) by 913 days.

(21) Appl. No.: 13/368,272

(22) Filed: Feb. 7, 2012

(65) Prior Publication Data

US 2013/0202822 A1 Aug. 8, 2013

(51) Int. Cl.

| | |
|---|---|
| ***A62C 3/02*** | (2006.01) |
| ***A62D 1/00*** | (2006.01) |
| ***A62C 35/10*** | (2006.01) |
| ***A62C 37/11*** | (2006.01) |

(52) U.S. Cl.

CPC . *A62D 1/00* (2013.01); *A62C 35/10* (2013.01); *A62C 37/11* (2013.01); *Y10T 428/13* (2015.01)

(58) Field of Classification Search

CPC ..... A62C 8/005; A62C 35/10; A62C 31/00; Y10T 428/13

USPC ..... 428/35.1; 169/52

See application file for complete search history.

(56) References Cited

U.S. PATENT DOCUMENTS

| | | | | |
|---|---|---|---|---|
| 117,891 | A | 8/1871 | Johnson | |
| 2,359,573 | A | 10/1944 | MacKay | |
| 4,113,020 | A | 9/1978 | Panetta | |
| 4,197,915 | A | 4/1980 | Martin | |
| 4,285,403 | A | 8/1981 | Poland | |
| 4,344,489 | A | 8/1982 | Bonaparte | |
| 6,318,473 | B1 | 11/2001 | Bartley et al. | |
| 6,796,382 | B2 | 9/2004 | Kaimart | |
| 7,083,000 | B2 * | 8/2006 | Edwards et al. | 169/47 |
| 7,261,165 | B1 | 8/2007 | Black | |
| 2010/0230120 | A1 * | 9/2010 | Silverstein | 169/52 |

FOREIGN PATENT DOCUMENTS

| | | |
|---|---|---|
| JP | 6-190077 | 7/1994 |

OTHER PUBLICATIONS

Website, http://www.alibaba.com/product-tp/118498775/Fire_Extinquisher_Ball.html, one sheet printed from the internet on Oct. 15, 2011.

* cited by examiner

*Primary Examiner* — Ellen S Wood
(74) *Attorney, Agent, or Firm* — Richard C. Litman

(57) ABSTRACT

The encapsulated fire extinguishing agents include a sealed outer shell containing at least one fire extinguishing agent therein. The shell is formed of material that melts when exposed to extreme heat, as in a fire. One embodiment has a single outer shell with a single fire retardant agent therein. Other embodiments may have a second shell within the outer shell, each shell defining an interior volume containing a separate fire extinguishing agent. The agents may combine to form a more effective fire extinguishing agent when the two shells melt. The shells may be formed to melt at different temperatures. Another embodiment includes an outer shell filled with a large number of smaller capsules, each of the smaller capsules filled with a fire extinguishing agent. The smaller capsules may each contain identical agents, or two or more different agents from one another.

12 Claims, 3 Drawing Sheets

ENCAPSULATED FIRE EXTINGUISHING AGENTS

BACKGROUND OF THE INVENTION

1. Field of the Invention

The present invention relates generally to devices and systems for extinguishing fires, and particularly to various embodiments of encapsulated fire extinguishing agents for use in extinguishing fires of various types and in various environments 2. Description of the Related Art Fire can be a very beneficial aid when controlled, but can cause great devastation when it is not controlled. Accordingly, numerous means for controlling fire have been developed in the past, ranging from small handheld fire extinguishers containing water or fire retardant chemicals to fire trucks, fire boats, and firefighting aircraft for larger fires.

Fires can further be classified according to the combustible material feeding the fire. In the U.S., a Class A fire involves the combustion of ordinary combustible materials, such as wood, paper, etc. Class B fires involve the combustion of combustible liquids and gases, while Class C fires designate electrical fires. Different materials and agents are used to combat these various fires, and some agents may be suited for only a single class of fire and may even increase the hazard when used in fighting other classes of fires. An example of such is water, which is one of the better agents for fighting class A fires involving wood, paper, and the like, but is extremely hazardous when used to fight a Class C electrical fire.

Aside from the necessity of providing the proper agent or material to combat the fire, depending upon the type or class of fire, there is also the need to apply the agent or material efficiently to the actual site of the fire. Generally, it is considered best to apply the firefighting agent or material to the base of the flames, where it will provide the greatest effect in both smothering the fire and reducing the heat required for combustion. While many chemical agents can be applied in such a manner to relatively small fires, it can be impractical to apply such agents and materials to larger fires, such as large structural fires and forest fires.

Conventionally, plain water is used on such fires, but water may not be as effective as many fire-retardant chemicals due to the tendency for water to break up into relatively small droplets and evaporate due to the extreme heat produced by the fire. Accordingly, it can require an inordinate amount of water to quench a large fire. While water may be available in plentiful quantities in urban environments having networks of water supplies and fire hydrants, the transport and delivery of water to more remote sites, such as forest fires and brush fires, can be a significant logistical problem. Aircraft have been used for quite some time in combating such fires, but they cannot provide the continuous supply of water needed to effectively fight such large-scale fires, and the smaller quantities of fire-retardant chemicals that might be more effective are often not readily available as quickly as they may be required.

Thus, encapsulated fire extinguishing agents solving the aforementioned problems are desired.

SUMMARY OF THE INVENTION

The encapsulated fire extinguishing agents each comprise an outer shell formed of a material subject to melting at relatively high temperatures, as would normally be encountered in a fire. The outer shell, and any inner shell(s) of certain embodiments, may be formed of suitable plastic material or other material that will melt when subjected to the heat of a fire. The shell or shells contain one or more fire extinguishing chemicals therein. The chemicals) may comprise a dry powder material, a gas (such as a halide or the like), or plain water or other liquid as desired, depending upon the type or class of fire of intended use for the capsule. When the capsule is dropped into a fire, the shell(s) quickly melt(s) to release the fire extinguishing chemical(s) therein at the immediate site of the fire, where the chemical(s) have their greatest effect.

In one embodiment, the encapsulated fire extinguishing agent comprises a single outer shell containing a single fire extinguishing chemical therein. In another embodiment, the encapsulated fire extinguishing agent comprises two shells defining two separate volumes, one shell being inside the other. Each volume contains a different fire extinguishing chemical. The two shells may be formed of different materials having different melting points. The two fire extinguishing chemicals may combine when their shells have melted to form a more effective fire extinguishing compound or mixture. Yet another embodiment comprises a single outer shell containing a plurality of smaller capsules therein, each of the smaller capsules being filled with a fire extinguishing chemical. The interstitial space between the smaller capsules may be filled with additional fire extinguishing chemical of the same or of a different type than that filling the smaller capsules. Alternatively, the interstitial space may be filled with a pressurized fire extinguishing or other gas to spread the smaller capsules when the larger outer capsule melts. A further embodiment of that described immediately above comprises the use of a plurality of different fire extinguishing chemicals within the smaller capsules contained within the larger outer capsule.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The encapsulated fire extinguishing agents each comprise a sealed outer shell that melts under the heat of a fire, the shell containing at least one fire extinguishing agent therein. The agent may be a solid, e.g., a powder, such as sodium bicarbonate; a liquid, e.g., water; or a gas, e.g., carbon dioxide. This list of exemplary fire extinguishing agents is by no means limiting, but serves merely to provide examples of potential fire extinguishing agents that may be used as fire extinguishing agents in the capsule(s).

Figure 1:
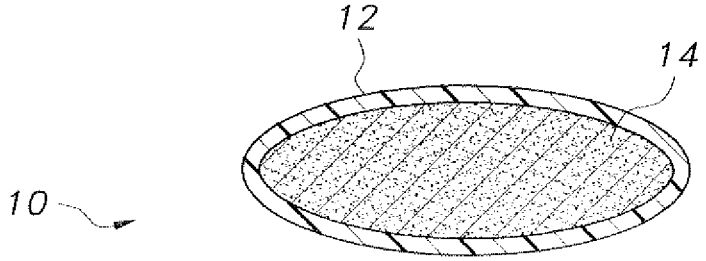
FIG. 1 is an elevation view in section of a first embodiment of an encapsulated fire extinguishing agent according to the present invention, showing the interior of a capsule containing a single agent.

FIG. 1 of the drawings illustrates the interior of a first embodiment of an encapsulated fire extinguishing agent 10 having a hermetically sealed outer shell or capsule 12 defining an internal volume containing a single fire extinguishing agent 14 therein. The capsule or shell may be elliptical in shape, as illustrated, or spherical or any other shape. The shell 12 is formed of a thin layer of material that is selected to melt when subjected to the heat of a fire. The melting point is preferably at least somewhat above the boiling point of water under standard conditions, i.e., 100° Celsius. A number of conventional plastics are known to have such characteristics and may be used to form the shell or capsule 12 of the encapsulated fire extinguishing agent 10. The fire extinguishing agent 14 may comprise any of a number of different materials.

Figure 2:
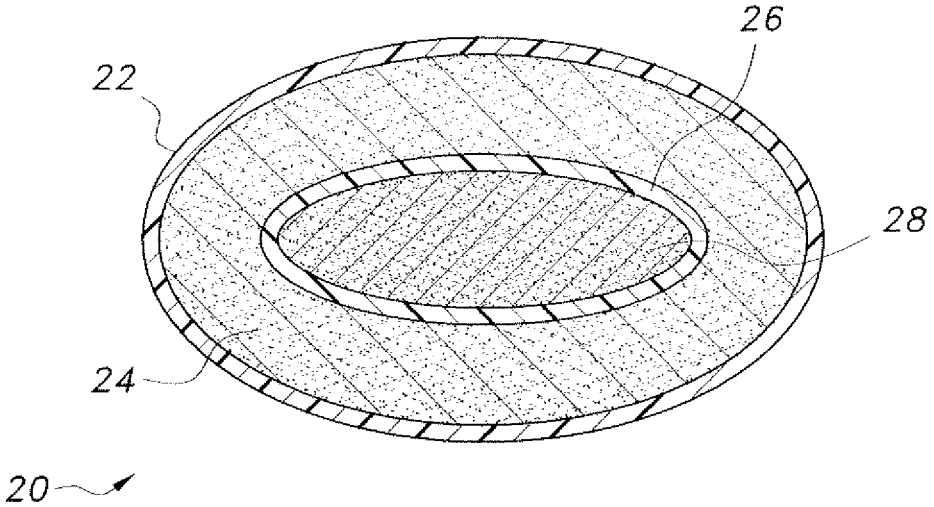
FIG. 2 is an elevation view in section of a second embodiment of an encapsulated fire extinguishing agent according to the present invention, showing the interior of a capsule containing separated multiple agents.

FIG. 2 of the drawings is an illustration of the interior of a second embodiment of an encapsulated fire extinguishing agent 20. This embodiment comprises a hermetically sealed first or outer shell or capsule 22 defining a first internal volume that is partially filled with a first fire extinguishing agent 24. However, a smaller second internal volume within the outer first shell 20, which is defined by a smaller second hermetically sealed capsule or shell 26, is installed within the internal volume of the larger first or outer shell 20. The smaller second internal shell or capsule 26 is filled with a second fire extinguishing agent 28. The two capsules or shells 22 and 26 may be formed of different materials having different melting temperatures. For example, the outer shell 22 may have a relatively low melting point in order to release its fire extinguishing agent 24 first, and the second or inner shell 26 may have a relatively higher melting point to release its fire extinguishing agent 28 somewhat later. Another alternative provides for the melting points of the two shells 22 and 26 to be identical in order to allow the two shells to melt simultaneously, thereby allowing the two fire extinguishing agents 24 and 28 to be released together so that they may mix with one another. Also, the two fire extinguishing agents 24 and 28 may be selected to combine with one another to form a mixture or chemical compound comprising a third fire extinguishing agent. Another embodiment provides for either or both of the internal volumes filled by the first and second fire extinguishing agents 24 and 28 to be pressurized at a pressure higher than ambient atmospheric pressure in order to disperse the fire extinguishing agent(s) 24 and/or 28 to a greater degree.

Figure 3:
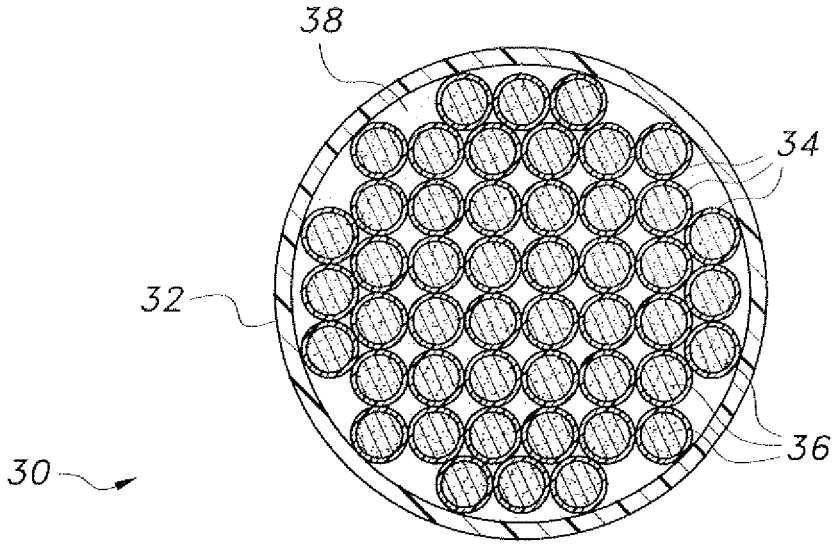
FIG. 3 is an elevation view in section of a third embodiment of an encapsulated fire extinguishing agent according to the present invention, showing the interior of a capsule containing a plurality of smaller capsules containing identical agents therein.

FIG. 3 of the drawings illustrates a further embodiment of an encapsulated fire extinguishing agent 30, wherein a single first or outer sealed shell or capsule 32 defines an internal volume containing a plurality of smaller inner sealed shells or capsules 34. The outer shell or capsule 32 and/or the various inner shells or capsules 34 may be spherical, as depicted in FIG. 3, or any other shape. It is not required that the inner shells or capsules 34 all be of the same shape. The inner capsules 34 may be of different shapes. As in the case of the other embodiments, the outer sealed shell 32 is formed of a material that melts when heated, e.g., plastic, etc., and the hermetically sealed inner shells 34 are also formed of a material that melts when exposed to the heat of a fire. Each of the inner shells 34 defines an internal volume containing a fire extinguishing agent 36 therein. The same points as noted in the discussion of the second embodiment of FIG. 2 will be seen to apply to the third embodiment of FIG. 3, i.e., different melting points for the outer shell 32 and the inner shells 34, pressurization of the internal volumes of the outer shell 32 and/or the internal volumes of the various inner shells 34, etc. The interstitial volume 38 remaining within the first or outer shell 32 between the second or inner shells 34 contained therein may be filled with any filler material, e.g., air or another fire extinguishing agent (e.g., powder, water, carbon dioxide, etc.).

Figure 4:
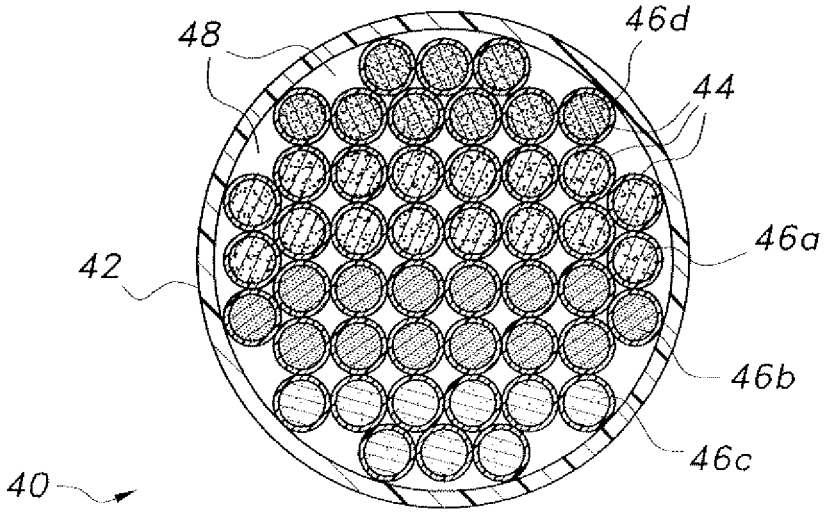
FIG. 4 is an elevation view in section of a fourth embodiment of an encapsulated fire extinguishing agent according to the present invention, showing the interior of a capsule containing a plurality of smaller capsules containing a plurality of different agents therein.

FIG. 4 illustrates an elevation view in section of another embodiment of an encapsulated fire extinguishing agent 40. This embodiment is similar to the encapsulated fire extinguishing agent 30 of FIG. 3, comprising a single first or outer sealed shell or capsule 42 defining an internal volume containing a plurality of smaller inner sealed shells or capsules 44. The outer shell or capsule 42 and/or the various inner shells or capsules 44 may be spherical, as depicted in FIGS. 3 and 4, or any other shape. It is not required that the inner shells or capsules 44 all be of the same shape. The inner capsules 44 may be of different shapes. As in the case of the other embodiments, the outer sealed shell 42 is formed of a material that melts when heated, e.g., plastic, etc., and the hermetically sealed inner shells 44 are also formed of a material that melts when exposed to the heat of a fire. Each of the inner shells 44 defines an internal volume containing a fire extinguishing agent therein. However, the various inner shells 44 may contain different types of fire extinguishing agents, four such different agents 46*a*, 46*b*, 46*c*, and 46*d* being illustrated in FIG. 4. It will be seen that the number of different agents is only limited by the number of second or inner capsules or shells 44 contained within the outer shell or capsule 42, and need not be limited to the four different types 44*a* through 44*d* illustrated in FIG. 4. The same points as noted in the discussion of the second embodiment of FIG. 2 and the third embodiment of FIG. 3 will be seen to apply to the fourth embodiment of FIG. 4, i.e., different melting points for the outer shell 42 and the inner shells 44, pressurization of the internal volumes of the outer shell 42 and/or the internal volumes of the various inner shells 44, etc. The interstitial volume 48 remaining within the first or outer shell 42 between the second or inner shells 44 contained therein may be filled with any filler material, e.g., air or another fire extinguishing agent (e.g., powder, water, carbon dioxide, etc.).

Figure 5:
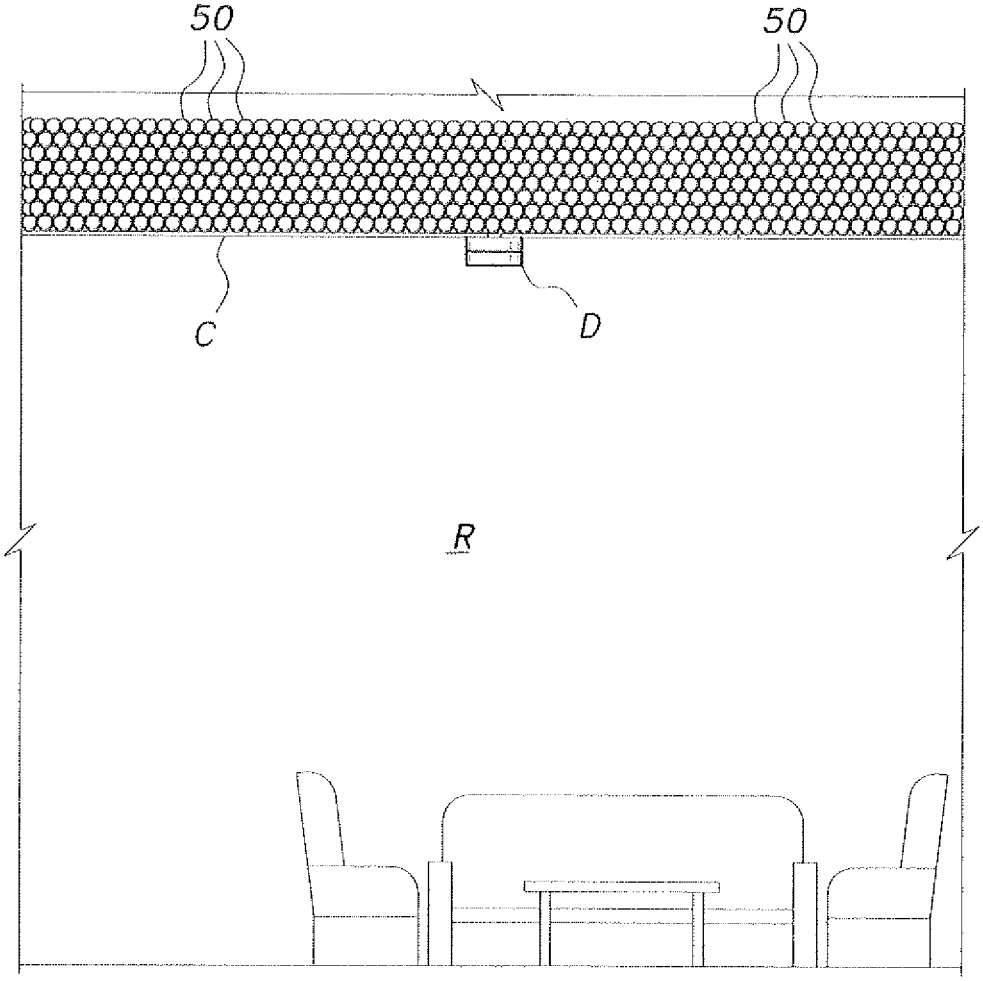
FIG. 5 is an environmental elevation view of an interior room of a structure, showing an exemplary installation of encapsulated fire extinguishing agents according to the present invention placed in the ceiling of the room for dispensing therefrom in the event of a fire.

FIG. 5 provides an environmental elevation view of the interior of a room R in which the ceiling C has been filled with a plurality of capsules 50 of the encapsulated fire extinguishing agents. The capsules 50 may comprise any of the four embodiments illustrated in FIGS. 1 through 4, or a mixture of any or all of the various embodiments in any percentage. A conventional fire detector D is installed on the ceiling C. The fire detector D releases a panel in the ceiling C by conventional electromechanical or other means when sufficient heat is detected. This allows the capsules 50 to drop from the ceiling C to extinguish the fire. The installation of capsules 50 in the ceiling C precludes any requirement for plumbing in the ceiling for a fire suppression system, thereby obviating any potential problems with water leakage, e.g., water damage to the property in general and/or to interior furnishings and valuables, etc. Alternatively, the capsules may be stored using various means, e.g., relatively small alternative containers adapted for carriage by hand that would allow the capsules to be dispensed by hand to extinguish small fires, such as by throwing the capsules into the fire.

Moreover, the fire extinguishing agent(s) of the capsules 50 may be selected for optimum efficiency, depending upon the type of fire that might be anticipated in such a structure or room. In the conventional residential room, water or firefighting foam might be the best choice. However, an industrial facility handling various flammable liquids might require a different fire extinguishing agent more suitable for use against class B fires. Similarly, fire extinguishing agents suited for use against a class C fire, as might occur in an electrical generator station or computer center, could be installed therewith. The various fire extinguishing agents that may be placed within the various capsules or shells of the encapsulated fire extinguishing agents may thus be adjusted or selected in accordance with the expected requirements, rather than being limited to a water supply or to agents transported from a distant location in response to an alarm.

It is to be understood that the present invention is not limited to the embodiments described above, but encompasses any and all embodiments within the scope of the following claims.

I claim:

1. An encapsulated fire extinguishing agent, comprising:

an outer sealed shell formed of a material melting upon exposure to heat from a fire, the shell defining a hollow interior;

at least a first fire extinguishing agent disposed within the hollow interior of the outer shell;

a plurality of hollow inner sealed shells disposed within the hollow interior of the outer shell, each of the inner sealed shells being formed of a material melting upon exposure to heat from a fire, each of the plurality of inner sealed shells having a second fire extinguishing agent disposed within its hollow interior; wherein the first fire extinguishing agent is disposed within the hollow interior of the outer shell between the outer shell and the plurality of inner sealed shells.

2. The encapsulated fire extinguishing agents according to claim 1, wherein the plurality of inner sealed shells have a pressure higher than ambient.

3. The encapsulated fire extinguishing agents according to claim 1, wherein the outer shell and the plurality of inner sealed shells each have different melting temperatures from one another.

4. The encapsulated fire extinguishing agents according to claim 1, further comprising a third fire extinguishing agent, the third fire extinguishing agent being formed of a mixture of the first fire extinguishing agent and the second fire extinguishing agent.

5. The encapsulated fire extinguishing agents according to claim 1, wherein said plurality of inner sealed shells have a plurality of different fire extinguishing agents disposed within the hollow interior of the shells, the fire extinguishing agent in each of the shells having a uniform composition.

6. An encapsulated fire extinguishing agent, comprising:

an outer hermetically sealed shell formed of a material melting upon exposure to heat from a fire, the shell defining a hollow interior;

at least one inner hermetically sealed shell disposed within the hollow interior of the outer shell, the at least one inner sealed shell being formed of a material melting upon exposure to heat from a fire, the at least one inner hermetically sealed shell defining a hollow interior;

a first fire extinguishing agent disposed solely within the hollow interior of the outer hermetically sealed shell and solely between the outer hermetically sealed shell and the at least one inner hermetically sealed shell; and at least one second fire extinguishing agent disposed solely within the hollow interior of the at least one inner hermetically sealed shell.

7. The encapsulated fire extinguishing agents according to claim 6, wherein the at least one inner shell has a pressure higher than ambient.

8. The encapsulated fire extinguishing agents according to claim 6, wherein the outer shell and the at least one inner shell each have a different melting temperature from one another.

9. The encapsulated fire extinguishing agents according to claim 6, wherein the first fire extinguishing agent and the second fire extinguishing agent combine to form a third fire extinguishing agent when the inner shell is melted and the first and second agents are mixed.

10. The encapsulated fire extinguishing agents according to claim 6, wherein said at least one inner sealed shell comprises a plurality of inner sealed shells, each of the plurality of inner sealed shells having a fire extinguishing agent disposed within its hollow interior.

11. The encapsulated fire extinguishing agents according to claim 10, wherein said plurality of inner sealed shells have a plurality of different fire extinguishing agents disposed within the hollow interior of the shells, the fire extinguishing agent in each of the shells having a uniform composition.

12. The encapsulated fire extinguishing agents according to claim 10, further comprising a fire extinguishing agent disposed between the outer shell and the plurality of inner sealed shells.

* * * * *